US005579589A

United States Patent [19]

Oechsle et al.

[11] Patent Number: 5,579,589

[45] Date of Patent: Dec. 3, 1996

[54] PROCESS AND APPARATUS FOR DRYING A FIBROUS WEB IN A SINGLE-FELT DRYER GROUP UNDER LOW VACUUM

[75] Inventors: Markus Oechsle, Bartholomae; Adolf Guggemos, Heidenheim, both of Germany

[73] Assignee: Voith Sulzer Papermaschinen GmbH, Germany

[21] Appl. No.: 441,321

[22] Filed: May 15, 1995

[51] Int. Cl.[6] ..... F26B 3/00; F26B 11/02; D06F 58/00

[52] U.S. Cl. ..... 34/446; 34/115; 34/117

[58] Field of Search ..... 34/90, 111, 116–117, 34/119–20, 123–25, 403, 406, 446; 162/358.1

[56] References Cited

U.S. PATENT DOCUMENTS

| | | | |
|---|---|---|---|
| 4,359,828 | 11/1982 | Thomas | 34/117 |
| 4,876,803 | 10/1989 | Wedel | 34/117 |
| 5,163,236 | 11/1992 | Heikkilä | 34/117 |
| 5,241,760 | 9/1993 | Wedel | 34/115 |
| 5,279,079 | 1/1994 | Skaugen et al. | 34/115 |
| 5,371,954 | 12/1994 | Pinter et al. | 34/117 |

FOREIGN PATENT DOCUMENTS 8300514 6/1983 WIPO .

*Primary Examiner*—John M. Sollecito
*Assistant Examiner*—Steve Gravini
*Attorney, Agent, or Firm*—Ostrolenk, Faber, Gerb & Soffen, LLP

[57] ABSTRACT

Apparatus and method for drying a fibrous web. The apparatus comprises a plurality of drying cylinders arranged in groups from a first group to a last group, the web passing sequentially from the first group to the last group, each group having a single felt, the drying cylinders having vacuum transfer rolls arranged therebetween for guiding the fibrous web from one drying cylinder to the next drying cylinder, the vacuum transfer rolls being coupled to a vacuum source by a vacuum duct system, the duct system providing vacuum to the vacuum transfer rolls such that the vacuum level decreases from the first group to the last group. The vacuum level is preferably below about 1500 Pa, and in particular, in the range of about 100 to 1000 Pa.

42 Claims, 4 Drawing Sheets

PROCESS AND APPARATUS FOR DRYING A FIBROUS WEB IN A SINGLE-FELT DRYER GROUP UNDER LOW VACUUM

BACKGROUND OF THE INVENTION

The present invention relates to paper manufacturing and papermaking machinery and methods, and in particular, to a process of drying a fibrous web in a single-felt dryer group wherein low vacuum is provided to the vacuum transfer rolls between dryer cylinders.

WO 83/00514 discloses the principle of drying a fibrous web in a single-felt dryer group having drying cylinders and suction rolls, without giving details on the degree of negative pressure in the suction rolls.

An article entitled Advances in Dryer Section Runnability, by G. L. Wedel & S. Palazzolo, TAPPI Journal, September 1987, pp. 65–69, discloses at p.67 "high vacuum" of 1000 Pa (approx. 4 in. $H_2O$) to hold the web to the "fabric" or porous support felt or belt, without giving details of the influence of the negative pressure upon shrinkage of the web.

U.S. Pat. No. 5,279,049 requires 1490–1990 Pa (approx. 6–8 inches $H_2O$) in the suction rolls in order to inhibit cross-directional web shrinkage "in the dry end of the dryer section".

U.S. Pat. No. 5,241,760 states that suction rolls are "unnecessary" in certain applications. Suggested are grooved transfer rolls without suction, with "inherent machine directional shrinkage of the web during drying thereof" inhibiting cross-directional web shrinkage.

DE 4328554A1 shows various dryer sections wherein the present invention is applicable.

The information contained in the second, third and fourth references above appears to be incomplete or at least ambiguous.

Also, it was found that the very high negative pressure required by U.S. Pat. No. 5,279,049 tends detrimentally to affect the web during the drying process. The result is low quality of the finished web. Further, in many cases, wrinkles are formed in the web, namely, in the web path around the suction rolls so that the web is unsaleable, resulting in a loss of productivity of the paper-making machine.

In certain applications (depending on the grade and/or on the basis weight of the fibrous web) even 1000 Pa (approx. 4 in. $H_2O$) may be too high in order to achieve a finished web having the quality and the properties required (e.g., for printing purposes).

SUMMARY OF THE INVENTION

Therefore, it is an object of the present invention to provide a drying process and apparatus in a single-felt dryer group which avoids the disadvantages of prior art processes.

More particularly, the drying process should be such that the cross-directional shrinkage of the web is decreased or even inhibited while any detrimental effect on the quality of the finished web is avoided.

Another object is to improve the known drying process such that forming of wrinkles is completely avoided so that the productivity of the papermaking process is improved.

The above and other objects of the invention are achieved by apparatus for drying a fibrous web comprising a plurality of drying cylinders arranged in groups from a first group to a last group, the web passing sequentially from the first group to the last group, each group having a single felt, the drying cylinders having vacuum transfer rolls arranged therebetween for guiding the fibrous web from one drying cylinder to the next drying cylinder, the vacuum transfer rolls being coupled to a vacuum source by a vacuum duct system, the duct system providing vacuum to the vacuum transfer rolls such that the vacuum level decreases from the first group to the last group.

The above and other objects of the invention are also achieved by apparatus for drying a fibrous web comprising a plurality of drying cylinders arranged in groups from a first group to a last group, the web passing sequentially from the first group to the last group, each group having a single felt, the drying cylinders having vacuum transfer rolls arranged therebetween for guiding the fibrous web from one drying cylinder to the next drying cylinder, the vacuum transfer rolls being coupled to a vacuum source by a vacuum duct system, the duct system providing vacuum to the vacuum transfer rolls such that the vacuum level is below approximately 1000 Pa.

The objects of the invention are also achieved by a method for drying a fibrous web comprising arranging a plurality of drying cylinders in groups from a first group to a last group, passing the web sequentially from the first group to the last group, each group having a single felt, applying vacuum to vacuum transfer rolls arranged between the drying cylinders for guiding the fibrous web from one drying cylinder to the next drying cylinder, coupling the vacuum transfer rolls to a vacuum source with a vacuum duct system and providing vacuum to the vacuum transfer rolls such that the vacuum level decreases from the first group to the last group.

The objects of the invention are also achieved by a method for drying a fibrous web comprising arranging a plurality of drying cylinders in groups from a first group to a last group, the web passing sequentially from the first group to the last group, each group having a single felt, applying vacuum to vacuum transfer rolls arranged between the drying cylinders for guiding the fibrous web from one drying cylinder to the next drying cylinder, coupling the vacuum transfer rolls to a vacuum source by a vacuum duct system, and providing vacuum to the vacuum transfer rolls such that the vacuum level is below approximately 1000 Pa.

Other features and advantages of the present invention will become apparent from the following description of the invention which refers to the accompanying drawings.

DETAILED DESCRIPTION

Figure 1A:
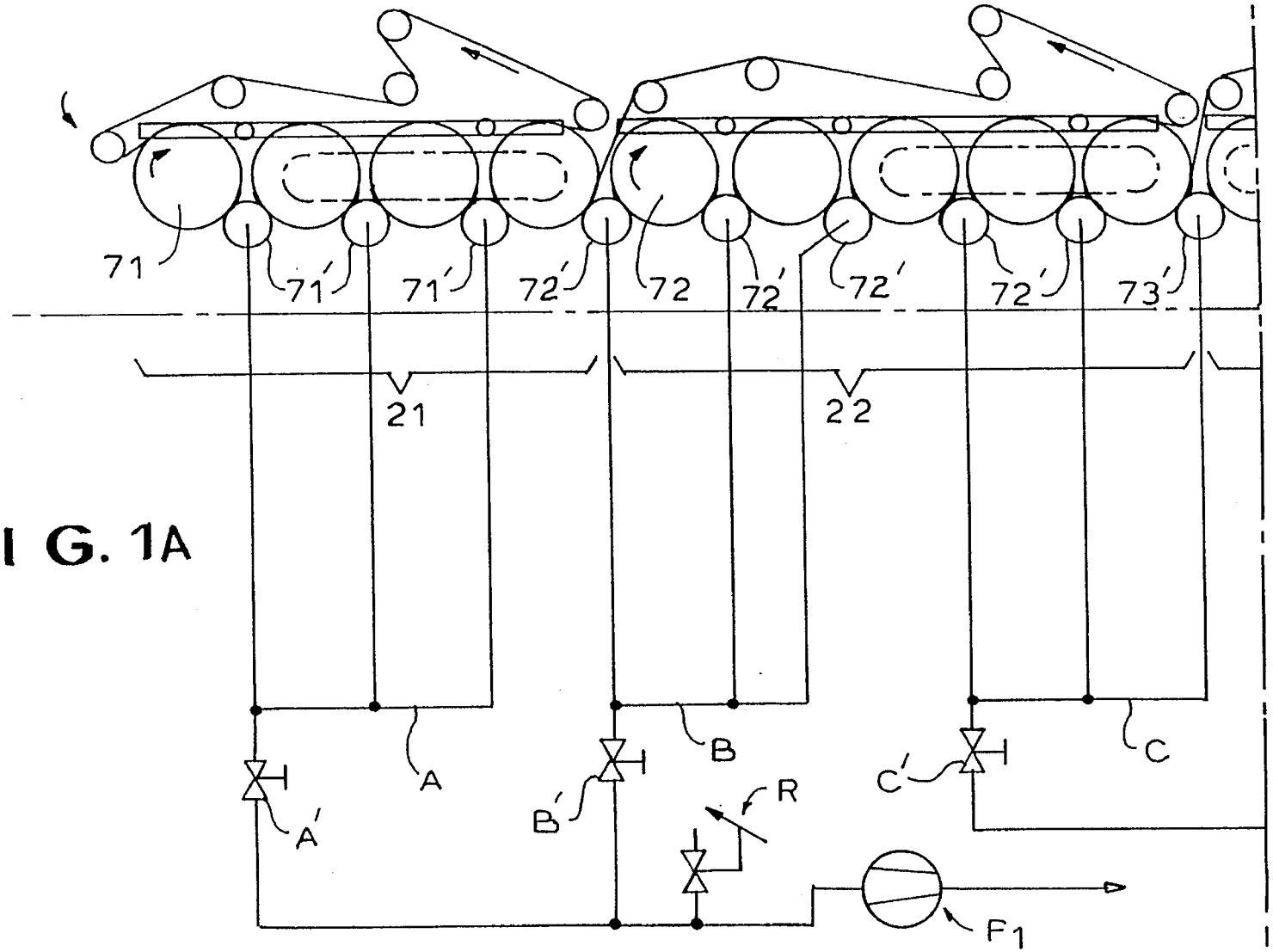
FIG. 1 shows a drying section of a paper making machine.
Figure 1B:
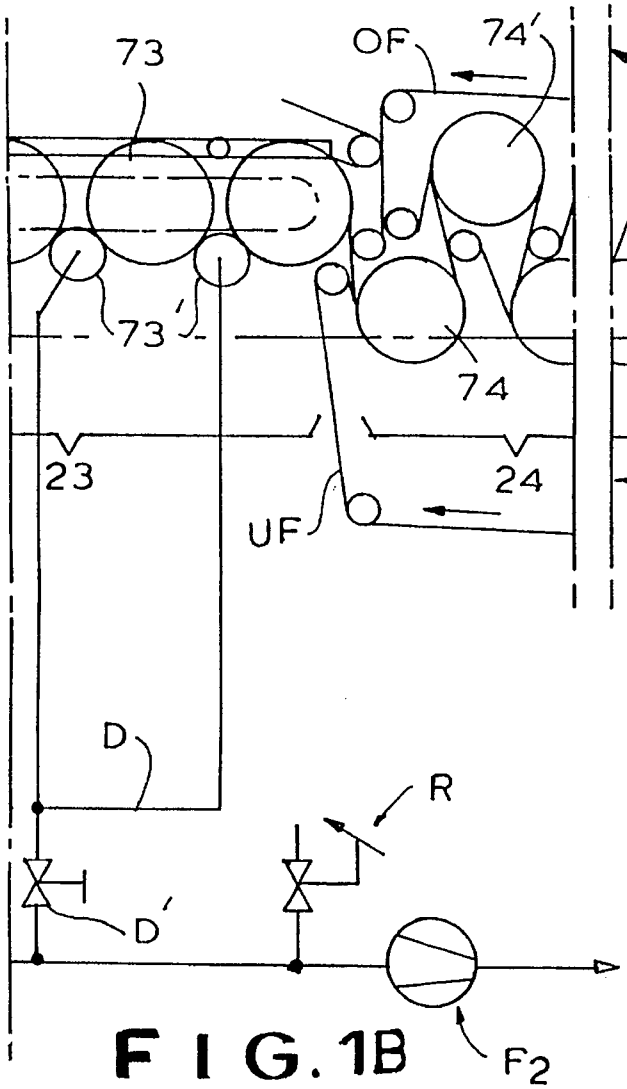

With reference now to the drawings, the dryer section shown in FIG. 1 has, for instance, three (or four or five) single-felt dryer groups 21–23. They may all be top-felted or be bottom felted or be a combination of top and bottom felted. In FIG. 1, all dryer cylinders 71–73 thus contact the bottom side of the web. The guide suction rolls 71' to 73' may have inner stationary suction boxes and may be arranged at only a slight distance from the adjacent dryer cylinders. Furthermore, for example, two (or three) double-felt dryer groups 24, 25 may be provided with bottom cylinders 74, 75 and with top cylinders 74' and 75'.

Figure 2A:
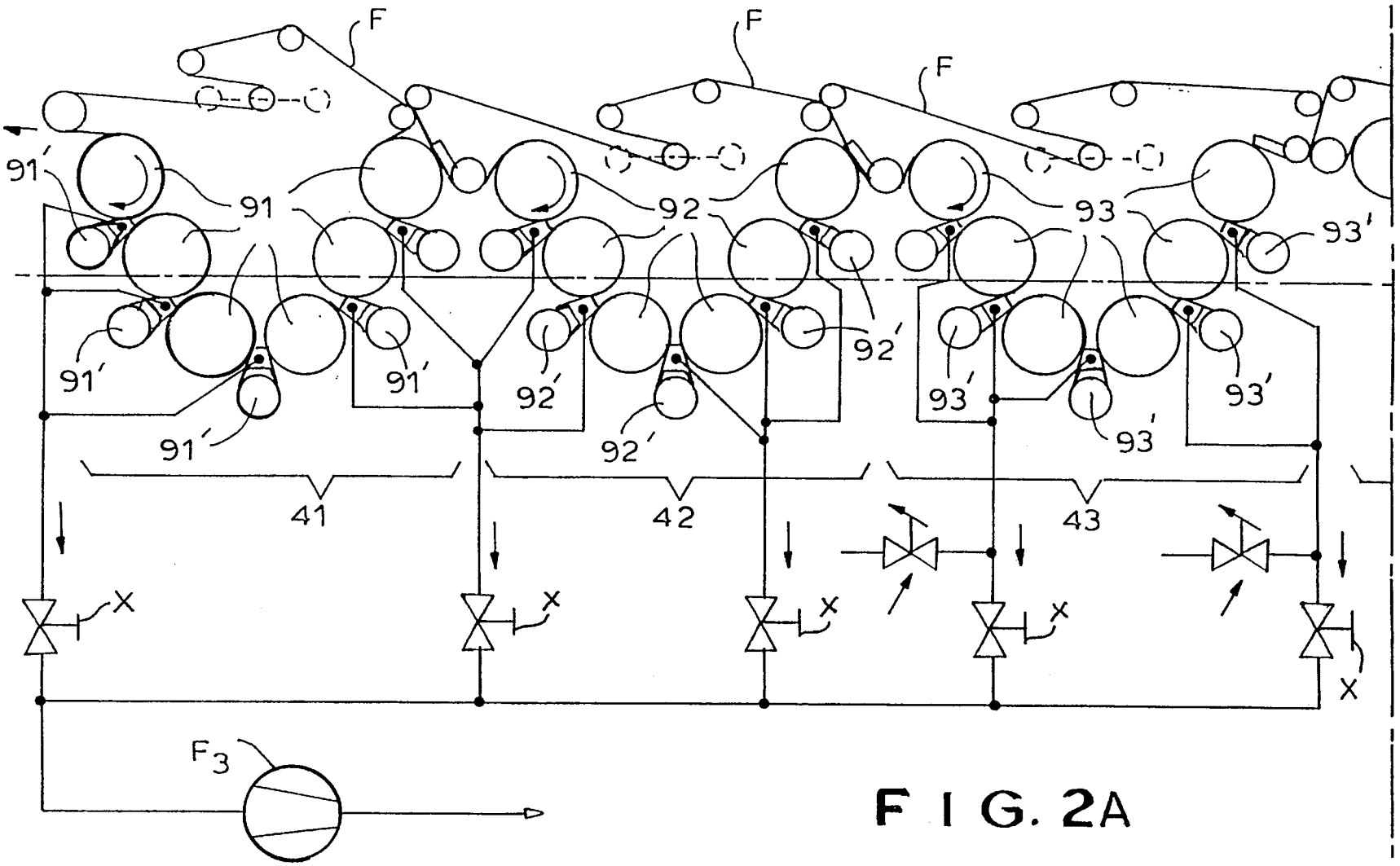
FIG. 2 shows another embodiment of a drying section of a papermaking machine.
Figure 2B:
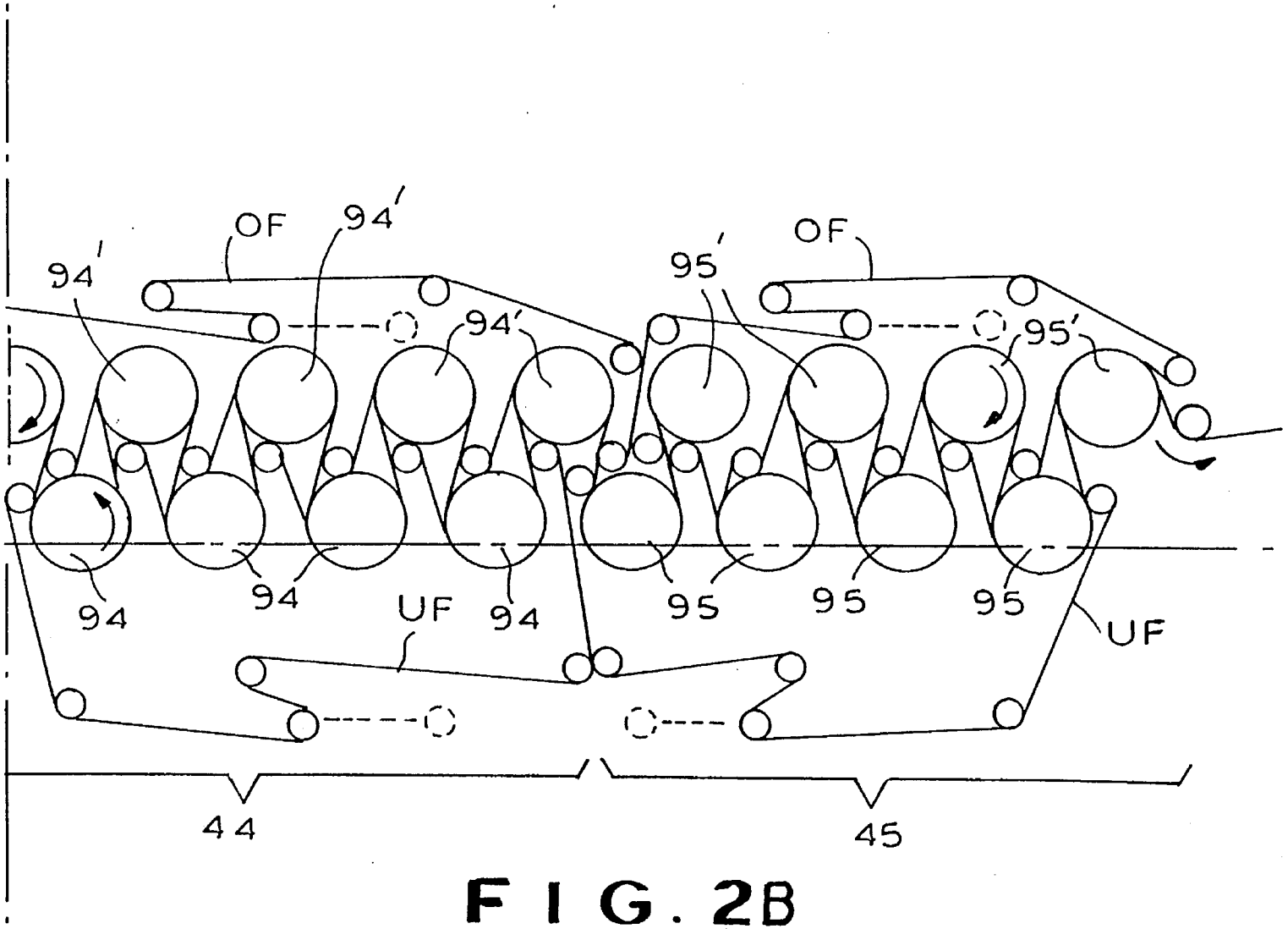

The dryer section of FIG. 1 has only horizontal rows of cylinders. In FIG. 2, however, in order to shorten the overall structural length of the dryer section, the cylinders of the single-felt dryer groups are arranged in several rows which are inclined to the vertical direction, with rows inclined rearwardly alternating with rows that are inclined forwardly. In accordance with FIG. 2, three V-shaped double rows form a first dryer group 41, a second dryer group 42 and a third group 43. The cylinders 91, 92 and 93 of these two dryer groups are top-felted. This is followed by two two-tier top and bottom-felted dryer groups 44, 45.

In FIG. 2, all transfer suction rolls 91' to 93' which are located in the corresponding dryer group between two cylinders may be arranged at a larger distance from these cylinders and may be provided with external suction boxes. This manner of construction does not merely involve less expense. It furthermore also saves drying section energy since a longer free evaporation path is present between every two cylinders so that drying is more economical. These latter factors apply also to the arrangement in accordance with FIG. 1.

It was found that it is possible to significantly improve the known drying process by limiting the negative pressure in the transfer suction rolls to values generally below 1500 Pa (approx. 6 in. $H_2O$), preferably between 100 and about 1000 Pa (approx. 0.4 in. $H_2O$ to approx. 4 in. $H_2O$).

More specifically, it was found that drying of many paper grades may be improved by applying even less negative pressure in the transfer suction rolls, namely in the range between 100 and about 600 Pa (approx. 0.4 to approx. 2.4 in. $H_2O$). In addition, it was found that cross-directional shrinkage during the drying of a paper web is clearly decreased if the negative pressure in the transfer suction rolls is relatively high in the initial area (where the web is still relatively wet) and if a lower negative pressure is applied in the middle and end areas of the single-felt drying section where the web is dryer. Along the single-felt drying section, the negative pressure applied in the suction rolls may decrease continuously from suction roll to suction roll or step-wise.

The application of a relatively low negative pressure in the end region of the single-felt drying groups (where the web is dryer) takes into account that the weight of the still wet web decreases continuously as the moisture content of the web decreases. Therefore, the centrifugal force acting on the web traveling around the suction rolls decreases from suction roll to suction roll, such that the negative pressure (needed to counteract against the centrifugal force and to hold the web onto the porous belt) may be lower when the web is dryer.

According to a further aspect of the invention, the level of negative pressure applied to the suction rolls may depend on the operating speed of the papermaking machine, which may be, e.g., in the range between 1000 and 2000 m/min. It was found that the negative pressure P should be calculated by the formula:

$$P=P1+(\mathfrak{V}-1000)/4\ [Pa],$$

wherein P1 is the negative pressure applied at a speed of 1000 m/min., and $\mathfrak{V}$ is the actual speed [m/min.].

Preferably, P1 is between 100 and 400 Pa (approx. 0.4 to 1.6 in. $H_2O$). Therefore, as an example, the negative pressure, at a speed of 1500 m/min, should be between 225 and 525 Pa (approx. 0.9 to 2.1 in. $H_2O$).

Further example:

Actual speed $\mathfrak{V}$=1600 m/min.

P1 in the first single-felt dryer group: 300 Pa (approx. 1.2 in. $H_2O$).

P1 in the last single-felt dryer group: 100 Pa (approx. 0.4 in. $H_2O$).

Thus, the actual negative pressure should be: P in the first single-felt dryer group: 450 Pa. (1.8 in. $H_2O$); and P in the last single-felt dryer group: 250 Pa (approx. 1 in. $H_2O$).

The suction rolls may have internal stationary suction boxes (FIG. 1) or external suction boxes arranged between two adjacent cylinders (FIG. 2).

As shown in FIG. 1,groups of the vacuum rolls 71' in the single tier section are provided with vacuum from common vacuum ducts A, B, C and D. A respective damper valve A', B', C' and D' connects the common vacuum ducts to respective sources of vacuum $F_1$ and $F_2$. $F_1$ produces a higher vacuum level than $F_2$. In the embodiment shown, valves A' and B' are coupled to source $F_1$ and valves C' and D' are coupled to Source $F_2$. The valves A', B', C' and D' allow the vacuum levels of the groups to be adjusted progressively lower through the dryer section as the paper is dried.

According to a further aspect of the invention, the negative pressure provided to the various vacuum rolls may be limited by at least one vacuum relief valve R which automatically opens if the negative pressure should become too high. Since the vacuum in the ducts is generally higher than the vacuum in the transfer rolls, it will be necessary to set the relief valves at substantially higher pressure thresholds than desired in the rolls to achieve the required vacuum levels in the rolls.

Figure 3:
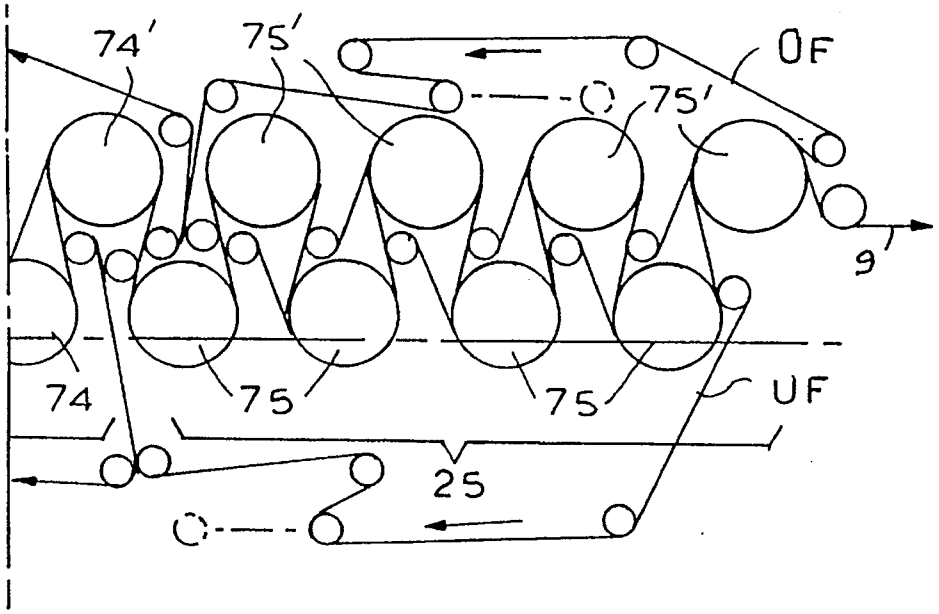
FIG. 3 shows a vacuum relief valve wherein a movable valve element is controlled by an adjustable counterweight.
Figure 3:
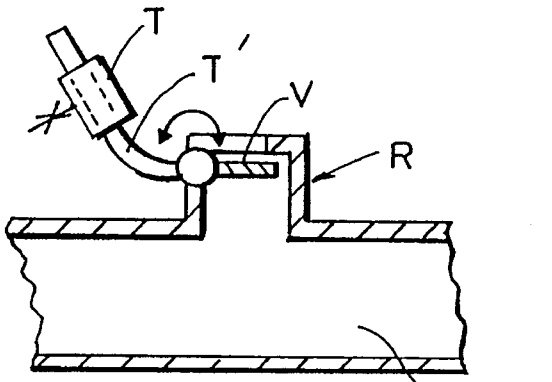

As shown in FIG. 3, the vacuum relief valves may comprise mechanical valves which automatically open when the negative pressure in the duct D' exceeds a threshold level set by a threshold setting member T. The threshold setting member T may include an adjustable counterweight fixed to a shaft T'. The location of weight T along shaft T' determines the threshold. When the vacuum exceeds the threshold, the valve plate V pivots, opening the relief valve and relieving the vacuum level in duct D.

In the apparatus of FIG. 2, suction rolls 91', 92' and 93' are subdivided into five vacuum subgroups, each having a suction level wherein the negative pressure may be adjusted individually by a valve X supplied by a vacuum source F3. To each suction line, a vacuum relief valve R may be connected, particularly at the end of the single-felt dryer groups where the web is dryer, as shown in FIG. 2. These relief valves R can have their thresholds adjusted differently so that lower vacuum levels are provided to the web as it gets progressively dryer.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. Apparatus for drying a fibrous web comprising:

a plurality of drying cylinders arranged in groups from a first group to a last group, the web passing sequentially from the first group to the last group, each group having a single felt, vacuum transfer rolls arranged between the drying cylinders for guiding the fibrous web from one drying cylinder to the next drying cylinder, the vacuum transfer rolls being coupled to a vacuum source by a vacuum duct system, the duct system providing vacuum to the vacuum transfer rolls such that the vacuum level decreases from the first group to the last group.

2. The apparatus of claim 1, wherein the duct system comprises a plurality of damper adjusting valves, the valves each associated with plural ones of said cylinders, thereby supplying substantially the same vacuum levels to those cylinders associated with a respective valve.

3. The apparatus of claim 2, wherein respective ones of said valves are coupled to vacuum sources supplying different vacuum levels, with the vacuum levels from the sources decreasing from the first group to the last group.

4. The apparatus of claim 3, further comprising vacuum relief valves associated with ones of said sources for maintaining the vacuum levels supplied into the duct system below a threshold level.

5. The apparatus of claim 2, further comprising a vacuum relief valve associated with respective ones of said valves for maintaining the vacuum levels supplied to the rolls by the valves below a threshold level.

6. The apparatus of claim 1, wherein the vacuum level is below approximately 1500 Pa below atmospheric pressure.

7. The apparatus of claim 6, wherein the vacuum level is between approximately 100 and 1000 Pa below atmospheric pressure.

8. The apparatus of claim 7, wherein the vacuum level is between approximately 100 and 600 Pa below atmospheric pressure.

9. The apparatus of claim 1, wherein the vacuum (P) is substantially determined by the equation:

$$P=P_1+(\mho-1000)/4\ Pa$$

where $P_i$=vacuum applied at a web speed of 1000 m/min and $\mho$ is the actual web speed.

10. The apparatus of claim 1, wherein the vacuum level decreases continuously from the first group to the last group.

11. The apparatus of claim 1, wherein the vacuum level decreases from the first group to the last group incrementally.

12. Apparatus for drying a fibrous web comprising:

a plurality of drying cylinders arranged in groups from a first group to a last group, the web passing sequentially from the first group to the last group, each group having a single felt, vacuum transfer rolls arranged between the drying cylinders for guiding the fibrous web from one drying cylinder to the next drying cylinder, the vacuum transfer rolls being coupled to a vacuum source by a vacuum duct system, the duct system providing vacuum to the vacuum transfer rolls such that the vacuum level is below approximately 1000 Pa below atmospheric pressure.

13. The apparatus of claim 12, wherein the vacuum level decreases from the first group to the last group.

14. The apparatus of claim 12, wherein the duct system comprises a plurality of damper adjusting valves, the valves each associated with plural ones of said cylinders, thereby supplying substantially the same vacuum levels to those cylinders associated with a respective valve.

15. The apparatus of claim 14, wherein respective ones of said valves are coupled to vacuum sources supplying different vacuum levels, with the vacuum levels from the sources decreasing from the first group to the last group.

16. The apparatus of claim 15, further comprising vacuum relief valves associated with ones of said sources for maintaining the vacuum levels supplied into the duct system below a threshold level.

17. The apparatus of claim 14, further comprising a vacuum relief valve associated with respective ones of said valves for maintaining the vacuum levels supplied to the rolls by the valves below a threshold level.

18. The apparatus of claim 12, wherein the vacuum level is between 100 and 600 Pa below atmospheric pressure.

19. The apparatus of claim 12, wherein the vacuum (P) is substantially determined by the equation.

$$P=P_1+(\mho-1000)/4\ Pa$$

where $P_1$=vacuum applied at a web speed of 1000 m/min and $\mho$ is the actual web speed.

20. The apparatus of claim 13, wherein the vacuum level decreases continuously from the first group to the last group.

21. The apparatus of claim 13, wherein the vacuum level decreases from the first group to the last group incrementally.

22. A method for drying a fibrous web comprising:

arranging a plurality of drying cylinders in groups from a first group to a last group, passing the web sequentially from the first group to the last group, each group having a single felt, applying vacuum to vacuum transfer rolls arranged between the drying cylinders for guiding the fibrous web from one drying cylinder to the next drying cylinder, coupling the vacuum transfer rolls to a vacuum source with a vacuum duct system, and providing vacuum to the vacuum transfer rolls such that the vacuum level decreases from the first group to the last group.

23. The method of claim 22, wherein the duct system comprises a plurality of damper adjusting valves, the valves each associated with plural ones of said cylinders, and further comprising supplying substantially the same vacuum levels to those cylinders associated with a respective valve.

24. The method of claim 23, wherein respective ones of said valves are coupled to vacuum sources supplying different vacuum levels, and further comprising providing the sources with vacuum levels decreasing from the first group to the last group.

25. The method of claim 24, further comprising maintaining the vacuum levels supplied into the duct system below a threshold level with vacuum relief valves associated with ones of said sources.

26. The method of claim 23, further comprising maintaining the vacuum levels supplied to the rolls by the valves below a threshold level with a vacuum relief valve associated with respective ones of said valves.

27. The method of claim 22, wherein the vacuum level is below approximately 1500 Pa below atmospheric pressure.

28. The method of claim 22, wherein the vacuum level is between approximately 100 and 1000 Pa below atmospheric pressure.

29. The method of claim 28, wherein the vacuum level is between approximately 100 and 600 Pa below atmospheric pressure.

30. The method of claim 22, wherein the vacuum (P) is substantially determined by the equation:

$$P=P_i+(\mho-1000)/4\ Pa$$

where $P_i$=vacuum applied at a web speed of 1000 m/min and $\mho$ is the actual web speed.

31. The method of claim 22, wherein the vacuum level decreases continuously from the first group to the last group.

32. The method of claim 22, wherein the vacuum level decreases from the first group to the last group incrementally.

33. A method for drying a fibrous web comprising:

arranging a plurality of drying cylinders in groups from a first group to a last group, passing the web sequentially from the first group to the last group, each group having a single felt, applying vacuum to vacuum transfer rolls arranged between the drying cylinders for guiding the fibrous web from one drying cylinder to the next drying cylinder, coupling the vacuum transfer rolls to a vacuum source by a vacuum duct system, and providing vacuum to the vacuum transfer rolls such that the vacuum level is below approximately 1000 Pa below atmospheric pressure.

34. The method of claim 33, wherein the vacuum level decreases from the first group to the last group.

35. The method of claim 33, wherein the duct system comprises a plurality of damper adjusting valves, the valves each associated with plural ones of said cylinders, and further comprising supplying substantially the same vacuum levels to those cylinders associated with a respective valve.

36. The method of claim 33, wherein respective ones of said valves are coupled to vacuum sources supplying different vacuum levels, and further comprising providing the sources with vacuum levels decreasing from the first group to the last group.

37. The method of claim 36, further comprising maintaining the vacuum levels supplied into the duct system below a threshold level with vacuum relief valves associated with ones of said sources.

38. The method of claim 36, further comprising maintaining the vacuum levels supplied to the rolls by the valves below a threshold level with a vacuum relief valve associated with respective ones of said valves.

39. The method of claim 33, wherein the vacuum level is between 100 and 600 Pa below atmospheric pressure.

40. The method of claim 33, wherein the vacuum (P) is substantially determined by the equation:

$$P=P_1+(\upsilon-1000)/4\ Pa$$

where $P_1$=vacuum applied at a web speed of 1000 m/min and $\upsilon$ is the actual web speed.

41. The method of claim 34, wherein the vacuum level decreases continuously from the first group to the last group.

42. The method of claim 34, wherein the vacuum level decreases from the first group to the last group incrementally.

* * * * *